US008414040B1

(12) United States Patent
Rhodes

(10) Patent No.: US 8,414,040 B1
(45) Date of Patent: Apr. 9, 2013

(54) DOOR HOLDING AND RELEASING DEVICE

(76) Inventor: Charles Rhodes, Altoona, PA (US)

( * ) Notice: Subject to any disclaimer, the term of this patent is extended or adjusted under 35 U.S.C. 154(b) by 310 days.

(21) Appl. No.: 12/897,847

(22) Filed: Oct. 5, 2010

(51) Int. Cl.
*E05C 19/18* (2006.01)

(52) U.S. Cl.
USPC ..... 292/288; 292/304

(58) Field of Classification Search ..... 292/304, 292/288, 342, 343
See application file for complete search history.

(56) References Cited

U.S. PATENT DOCUMENTS

| | | | | |
|---|---|---|---|---|
| 1,518,643 | A | 12/1924 | Faubert | |
| 3,433,518 | A * | 3/1969 | Foltz | 292/238 |
| 4,494,784 | A | 1/1985 | Haynes | |
| 5,127,688 | A | 7/1992 | Eldh | |
| 5,358,292 | A * | 10/1994 | Van Wiebe et al. | 292/235 |
| 5,689,853 | A | 11/1997 | Lemmer | |
| D453,470 | S | 2/2002 | Prasad | |
| 6,454,323 | B1 * | 9/2002 | Mills | 292/339 |
| 6,527,308 | B2 | 3/2003 | Linares | |
| 7,137,655 | B2 * | 11/2006 | Quarberg | 292/339 |
| 7,338,098 | B1 | 3/2008 | O'Kelley | |
| 7,437,900 | B1 * | 10/2008 | Slone | 70/94 |
| 2011/0254289 | A1 * | 10/2011 | Calamia, III | 292/336.3 |

* cited by examiner

*Primary Examiner* — Kristina Fulton
(74) *Attorney, Agent, or Firm* — Kyle Fletcher

(57) ABSTRACT

The door holding and releasing device includes a stand upon which a rotatable doorman is located and connected to a string that rotates said doorman atop said stand. The doorman, when engaged, shall hold a door in an opened state. A spring attaches between the stand and doorman in order to return the doorman to a position to hold a door open. The door holding and releasing device is preferably used with a spring-loaded door that returns to a closed position.

13 Claims, 8 Drawing Sheets

DOOR HOLDING AND RELEASING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of door accessories, more specifically, a device that can hold a door open and release a door.

B. Discussion of the Prior Art

As will be discussed immediately below, no prior art discloses a door holding and releasing device that includes a stand that is placed outside of said door and includes a doorman that rotates about said stand, and wherein said doorman when engaged shall keep a door in an opened state; wherein a string tied to said doorman extends to an opposing said of said door and upon pulling of said string will rotate the doorman thereby releasing the door, and whereupon said door will return to a closed position.

The Eldh patent (U.S. Pat. No. 5,127,688) discloses a door holding device having a pivotable latch device that is swung to a latching position when the door is opened, and the door is released by swinging the latch to the release position. However, the device does not include a stand located outside of said door that holds a door in an opened state until pulling upon a cord that extends through the opening between the door and door frame to release said door.

The O'Kelley et al. patent (U.S. Pat. No. 7,338,098) discloses a device for holding a door open having a ready release mechanism comprising a latch pivotally supported on a bracket and a release lever pivotally supported on the latch. However, the device does not utilize a stand located outside of said door that holds a door in an opened state until pulling upon a cord that extends through the opening between the door and door frame to release said door.

The Haynes patent (U.S. Pat. No. 4,494,784) discloses a door stop for the handicapped comprising a pivoting cross bar mounted at a convenient height traverse to the door connected by means of a lever to a door-stop at the corner of the door. However, the door stop relies upon hardware installed upon a side of said door and does not use a stand that is placed outside of a door so as to hold a door in an opened position until it needs to be let go and close.

The Lemmer patent (U.S. Pat. No. 5,689,853) discloses a closure member restraining device comprising a catch that is spring mounted and thus movable into a recess for restraining and releasing a door. Again, the device does not include a stand that is palced outside of a door and holds a door open until a string releases said door.

The Faubert patent (U.S. Pat. No. 1,518,643) discloses a door holder comprising a swinging bolt or hook member together with means operating upon impact for moving the bolt or hook member into a position to engage and hold the door. Again, the device does not include a stand that is placed outside of a door and holds a door open until a string releases said door.

The Prasad patent (U.S. Pat. No. Des. 453,470) illustrates a design for an adjustable door barricade, which does not depict a stand having a doorman mounted atop.

While the above-described devices fulfill their respective and particular objects and requirements, they do not describe a door holding and releasing device that includes a stand that is placed outside of said door and includes a doorman that rotates about said stand, and wherein said doorman when engaged shall keep a door in an opened state; wherein a string tied to said doorman extends to an opposing said of said door and upon pulling of said string will rotate the doorman thereby releasing the door, and whereupon said door will return to a closed position. In this regard, the door holding and releasing device departs from the conventional concepts and designs of the prior art.

SUMMARY OF THE INVENTION

The door holding and releasing device includes a stand upon which a rotatable doorman is located and connected to a string that rotates said doorman atop said stand. The doorman, when engaged, shall hold a door in an opened state. A spring attaches between the stand and doorman in order to return the doorman to a position to hold a door open. The door holding and releasing device is preferably used with a spring-loaded door that returns to a closed position.

It is an object of the invention to provide a door holding and releasing device that can hold a door in an open position until an end user acts upon a string thereby disengaging a doorman, and thus releasing a door to return to a closed state.

A further object of the invention is to provide a stand that is highly mobile, and can be placed on an exterior surface adjacent a door.

A further object of the invention is to provide a stand that is an aftermarket accessory that can work with any door to hold said door in an opened position until so released.

A further object of the invention is to provide to a string that attaches to the doorman and extends to an interior space adjacent an inside of said door.

A further object of the invention is to include a spring to return the doorman to a position to hold the door open.

These together with additional objects, features and advantages of the door holding and releasing device will be readily apparent to those of ordinary skill in the art upon reading the following detailed description of presently preferred, but nonetheless illustrative, embodiments of the door holding and releasing device when taken in conjunction with the accompanying drawings.

In this respect, before explaining the current embodiments of the door holding and releasing device in detail, it is to be understood that the door holding and releasing device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the door holding and releasing device.

It is therefore important that the claims be regarded as including such equivalent construction insofar as they do not depart from the spirit and scope of the door holding and releasing device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
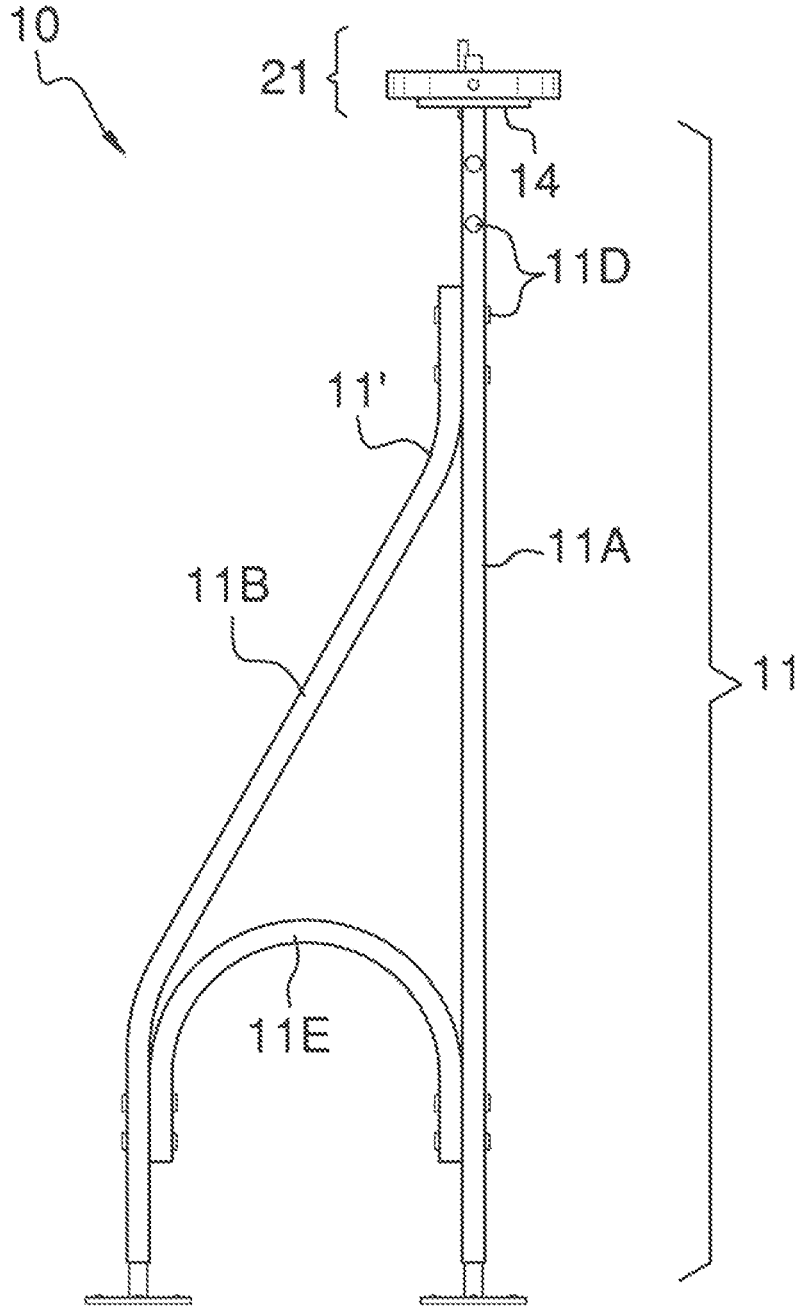
FIG. 1 illustrates a front view of the door holding and releasing device by itself.
Figure 2:
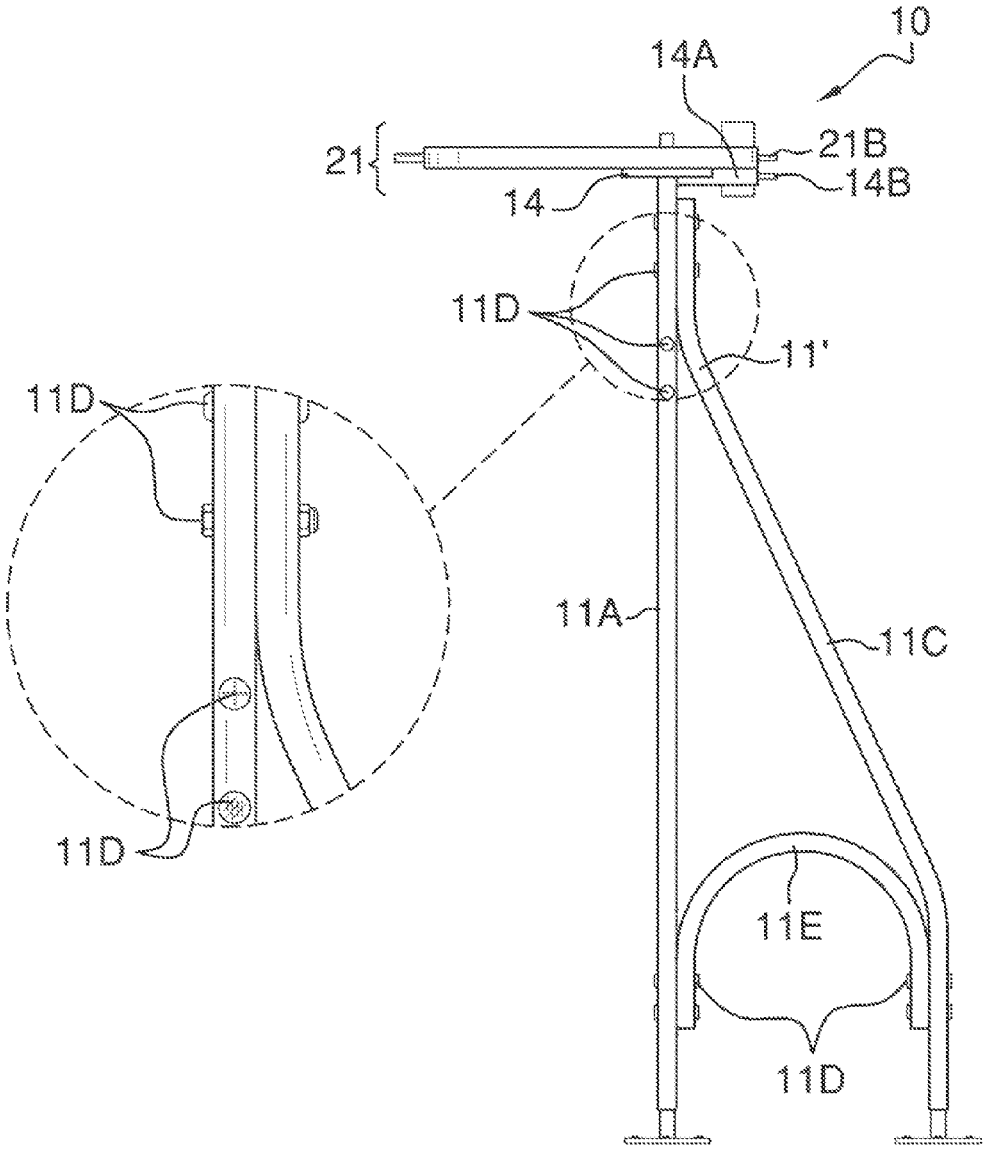
FIG. 2 illustrates a side view of the door holding and releasing device by itself with a detail of the various attaching means used.
Figure 3:
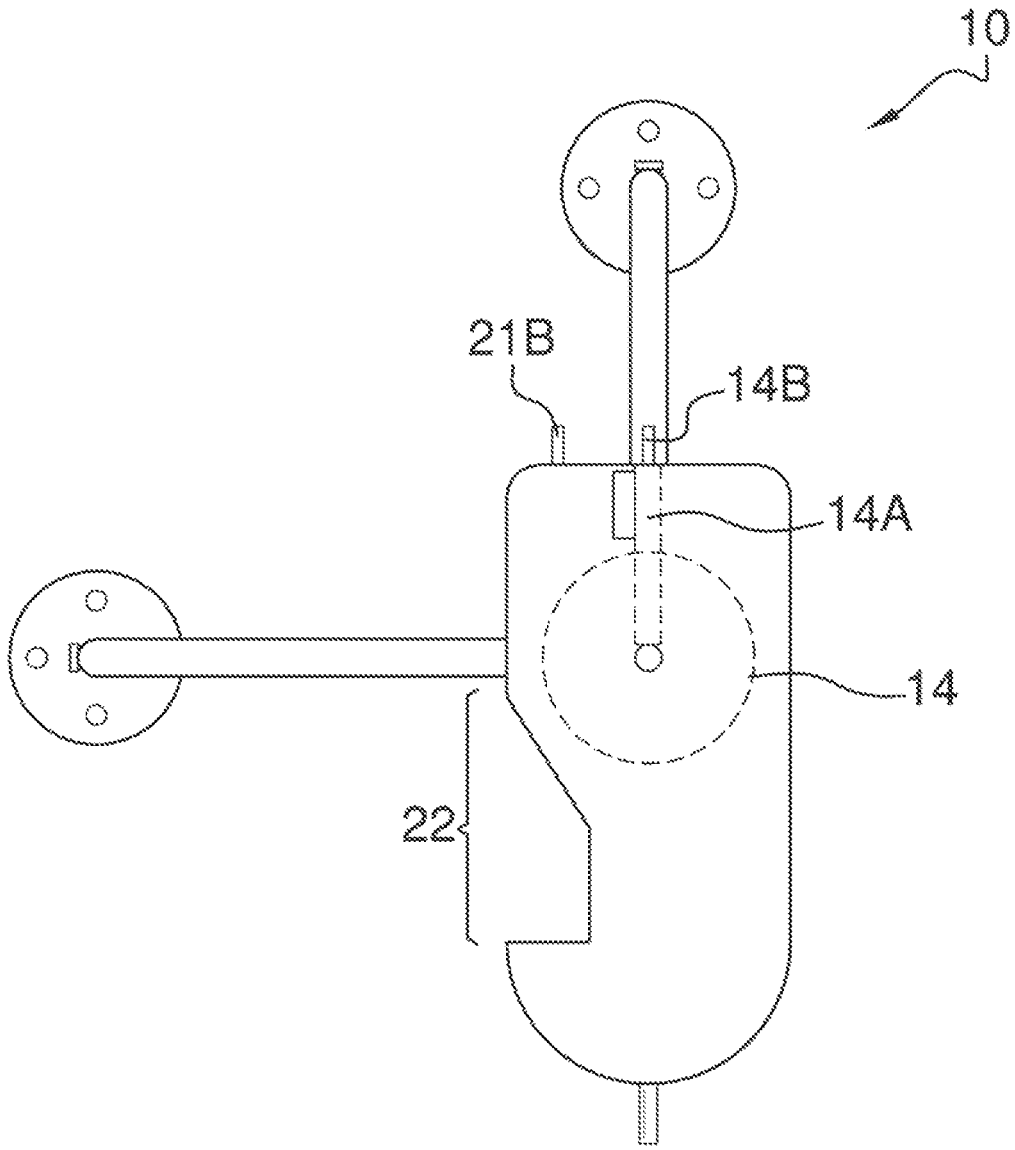
FIG. 3 illustrates a top view of the door holding and releasing device and depicting the hinge in dashed lines.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A door holding and releasing device 10 (hereinafter invention) includes a stand 11, a doorman 21, and a string 41.

The stand 11 is composed of a tri-pod base that supports the invention 10. The stand 11 consists of a central post 11A, a left post 11B, and a right post 11C. Both the left post 11B and the right post 11C attach to the central post 11A via attaching means 11D. The attaching means comprise bolts, screws, nails, or rivets. Additionally, both the left post 11B and the right post 11C have a curve 11' in their shape so as to bend away from the central post 11A in order to provide stability to the stand 11.

The stand 11 also includes braces 11E that each connect between the central post 11A and the left post 11B or the right post 11C. The braces 11E utilize the attaching means 11D to secure itself to either the central post 11A and the left post 11B or the right post 11C.

The stand 11 also includes feet 12 that attach to the central post 11A, the left post 11B, and the right post 11C. The feet 12 are designed to secure the stand 11 to ground adjacent a door 30. That being said, the feet 12 may include the attaching means 11D that secure the stand 11 to a ground surface.

Figure 6:
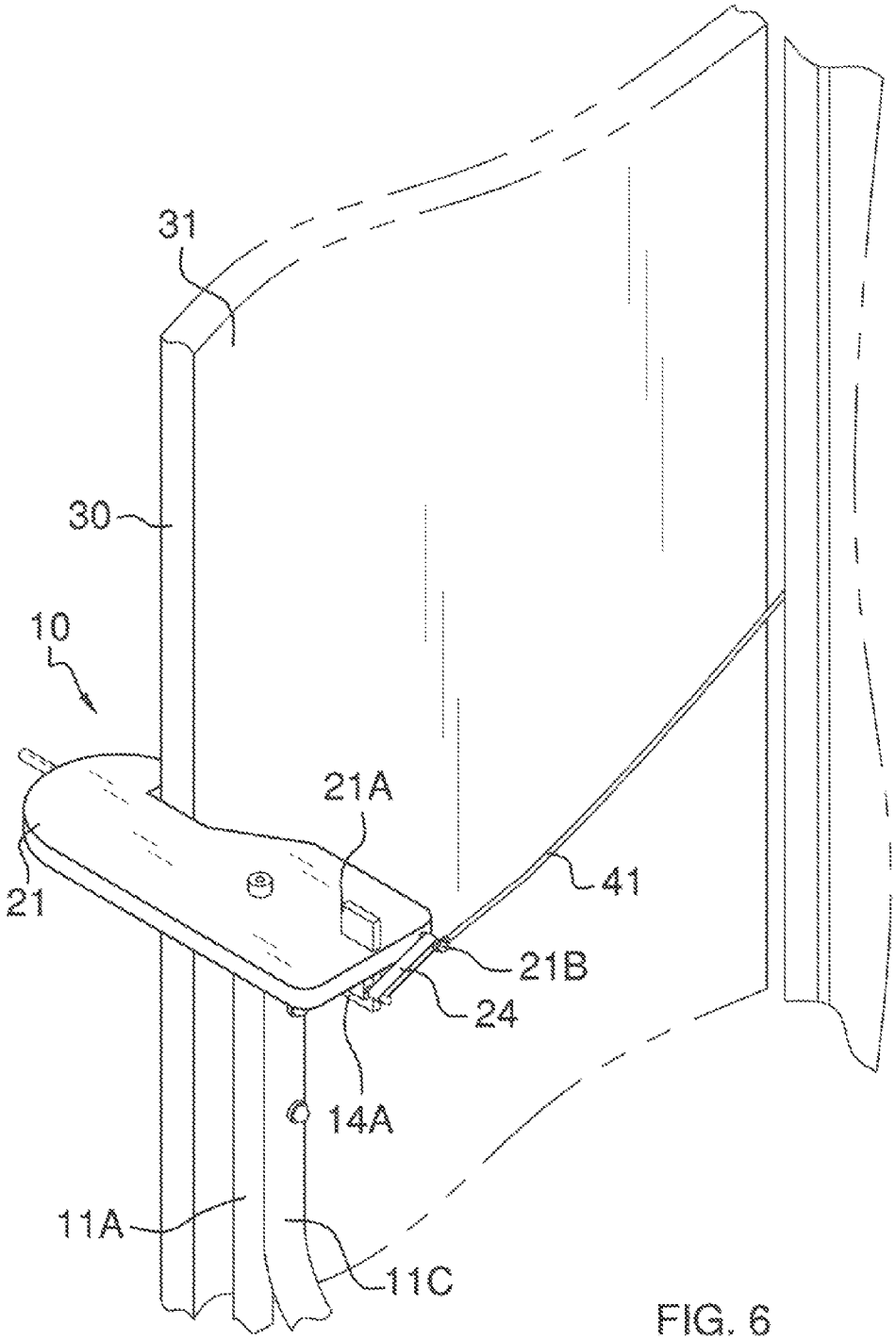
FIG. 6 illustrates a detailed, rear view of the door holding and releasing device and depicting the inter-relation of the string, recoiling means, stand, and doorman.
Figure 6A:
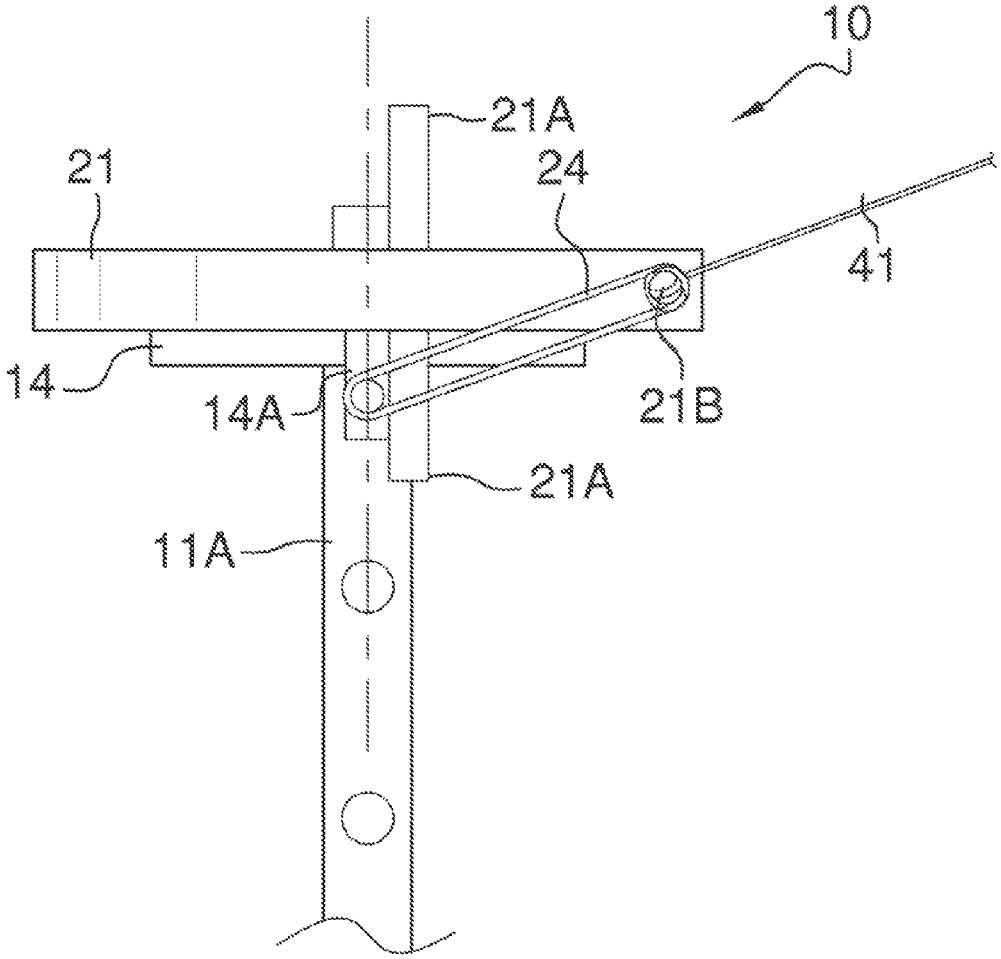
FIG. 6A. illustrates a rear view of the door holding and releasing device whereby further detailing the inter-relation of the doorman, fins, recoiling means, string, circle bracket, and arm of the circle bracket.
Figure 7:
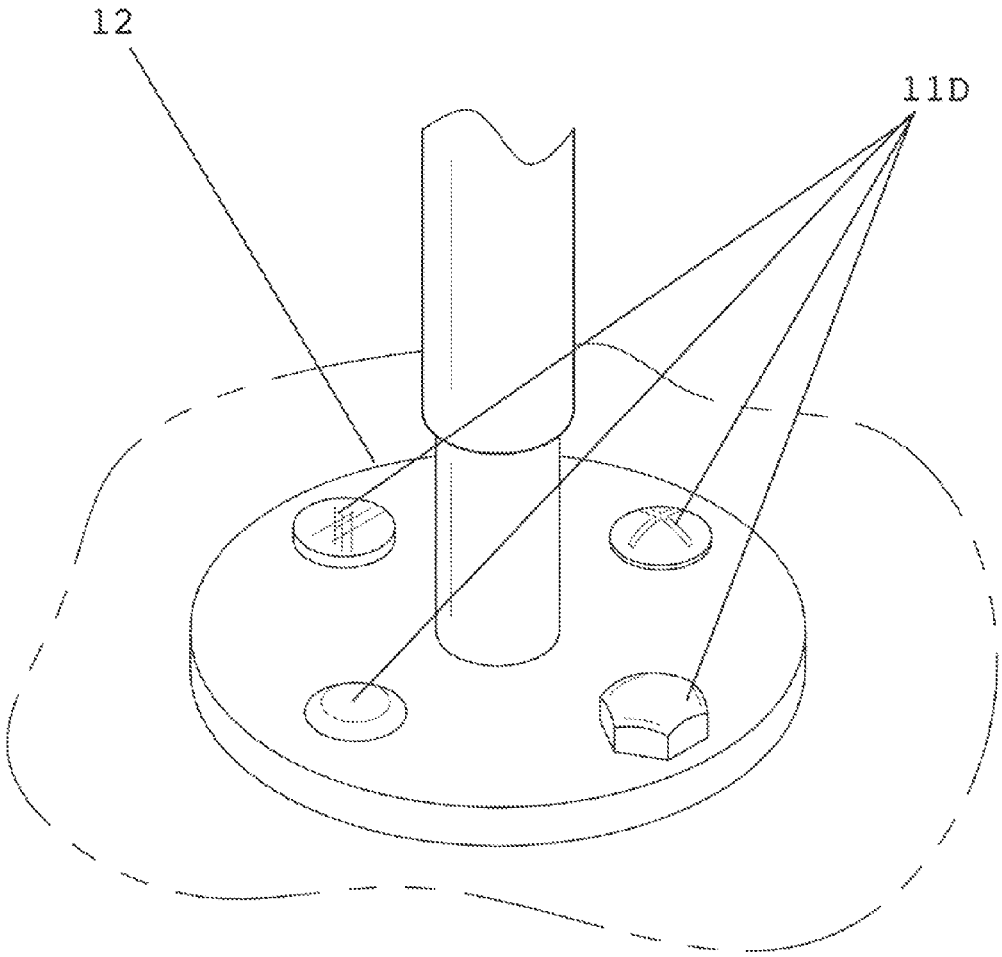
FIG. 7 illustrates a detailed view of the foot plate and attaching means that may be used to secure the invention to the ground.

The central post 11A of the stand 11 attaches to the doorman 21. The doorman 21 can rotate atop the central post 11A. Located adjacent the doorman 21 and mounted onto the central post 11A is a circle bracket 14. The circle bracket 14 is affixed to the central post 11A such that the circle bracket 14 cannot rotate thereon. The circle bracket 14 has an arm 14A that is mounted on the circle bracket 14, but is offset from being radially aligned on the circle bracket 14 (see FIG. 6A). The arm 14A has a catch 14B located on an end of the arm 14A that extends farthest from the circle bracket 14.

The doorman 21 has fins 21A that extend vertically from an end of the doorman 21. The fins 21A are securely affixed to the doorman 21. A catch 21B extends away from an end of the doorman 21. A recoiling means 24 attaches to the catch 14B of the arm 14A and to the catch 21B of the doorman 21. The recoiling means 24 essentially connects the doorman 21 to the circle bracket 14 and ensures that the doorman 21 will return to an aligned position with the circle bracket 14 between use of the invention 10. The recoiling means 24 is essentially an elastic band that is wrapped around both the catch 14B of the circle bracket 14 and the catch 21B of the doorman 21 thereby imposing a biasing force that causes the doorman 21 to rotate to a return position capable of holding the door 30 in an opened position.

The fins 21A of the doorman 21 act as a stop to prevent over-rotation of the doorman 21 with respect to the circle bracket 14. The fins 21A act as a stop by rotating until said fin 21A rests against the arm 14A of the circle bracket 14.

Use of the invention 10 requires an end user 32 to pull on the string 41 via a loop 41A. The string 41 in turn rotates the doorman 21 about both the center post 11A and the circle bracket 14, until the doorman 21 disengages the door 30, and whereupon the door 30 can rotate to close. The string 41 attaches to the doorman 21 via the catch 21B. The loop 41 is located on an opposite end of the string 41.

Figure 4:
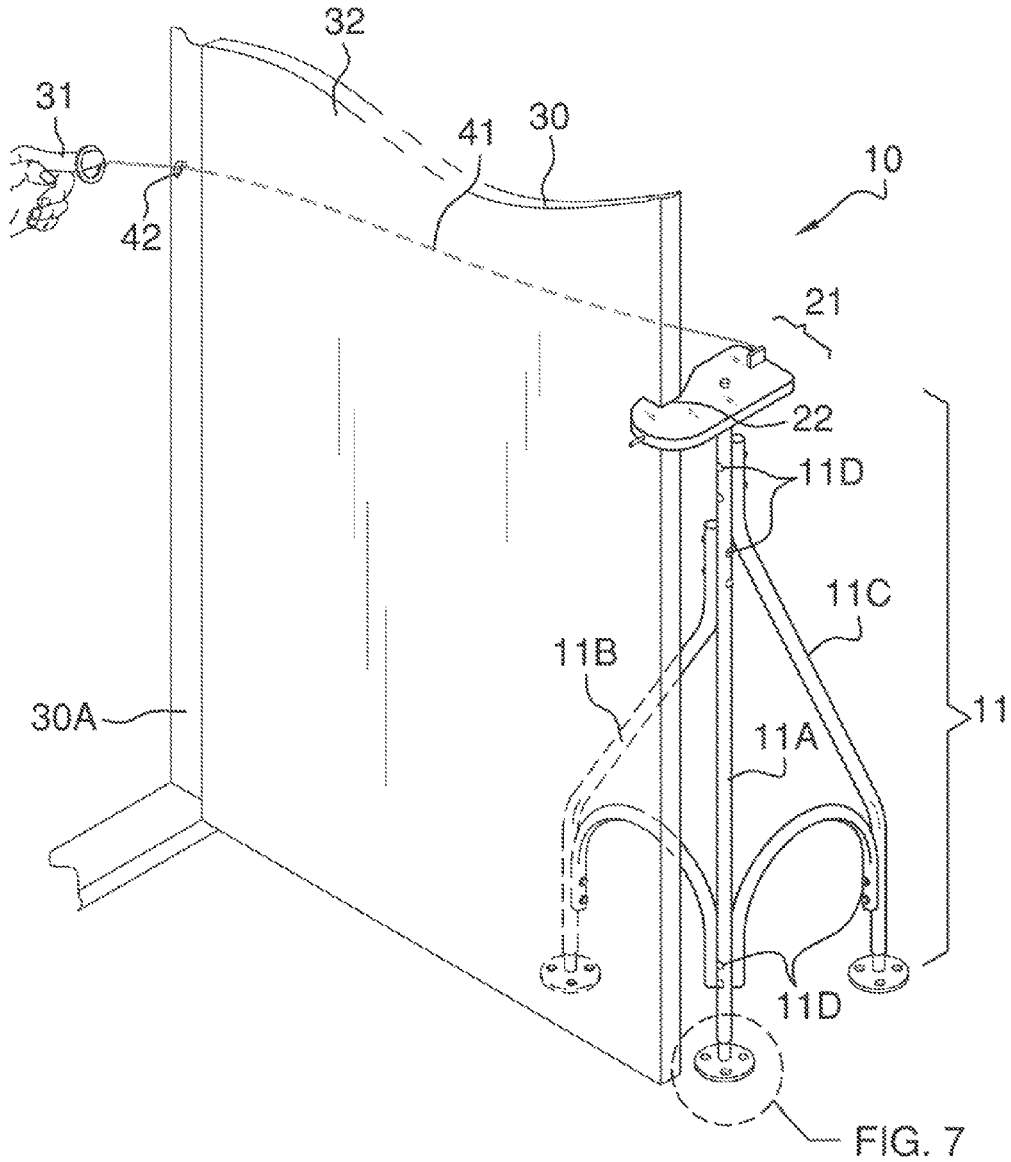
FIG. 4 illustrates a front, isometric view of the door holding and releasing device in use and holding a door open while an end user has a finger in use with the ring pull.
Figure 5:
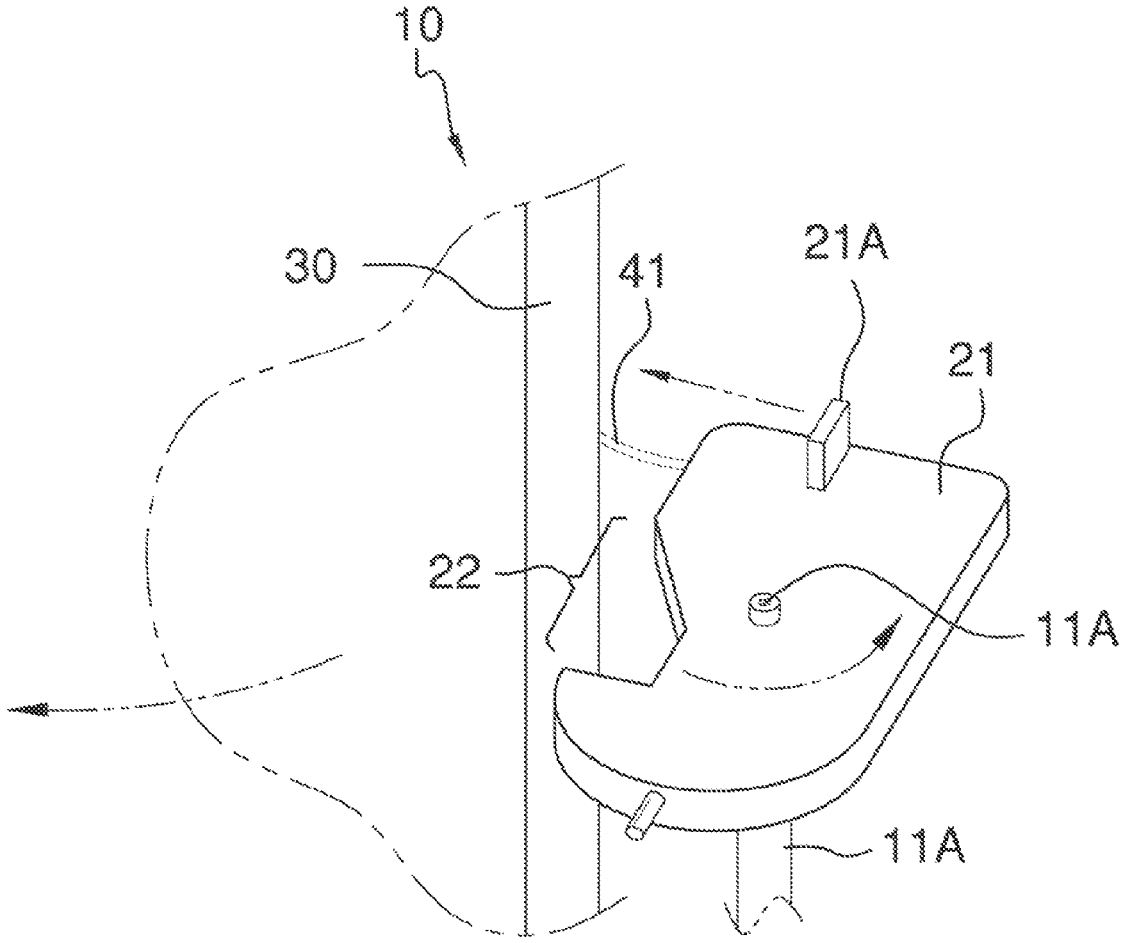
FIG. 5 illustrates a front, isometric view of the door holding and releasing device with the hinge being rotated upon pulling of the string, and thereby releasing the door, which is defined by an arrow indicating movement of the door.

The doorman 21 also has a door catch 22 that engages an end of the door 30 so as to hold said door 30 at whatever angle formed via the location of the stand 11 relative to the door 30 and doorframe 30A. The door catch 22 is a notch that is cut out of the doorman 21. The string 41 may pass through an eyelet 42 mounted on the doorframe 30A (see FIG. 4). Coincidentally, the string 41 passes along an outer surface of the door 30 before entering between the door 30 and the doorframe 30A. Referring to FIG. 4 wherein the string 41 in dashed lines as crossing said outer surface 31 of the door. It shall be noted that an inner surface 32 of the door 30 is on a side of the door 30 opposite the stand 11.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A door holding and releasing device comprising:

a stand placed on a ground adjacent a door;

wherein a doorman rotates atop said stand;

wherein the doorman can hold a door in an open position until rotated via a string thereby releasing said door, and wherein said door rotates to a closed position;

wherein a recoiling means imposes a biasing force upon both the doorman and the stand so as to return the doorman to a return position with respect to the stand;

wherein a circle bracket having an offset arm are mounted on the stand underneath the doorman; wherein the arm of the circle bracket has a catch; wherein the doorman includes a catch; wherein the recoiling means attaches to catch on the circle bracket and the catch on the doorman;

wherein the doorman has fins that extend vertically and of which engage the arm of the circle bracket so as to return the doorman to the return position.

2. The door holding and releasing device as described in claim 1 wherein the doorman has a door catch that is a notch out of the doorman, which is responsible for engaging and holding said door until rotated thereby releasing said door.

3. The door holding and releasing device as described in claim 1 wherein the stand is comprised of three posts that form a tri-pod.

4. The door holding and releasing device as described in claim 3 wherein feet attach to each post to secure said stand to the ground adjacent the door.

5. The door holding and releasing device as described in claim 4 wherein the feet include attaching means for securing the frame to the ground adjacent the door.

6. The door holding and releasing device as described in claim 1 wherein the string travels across an exterior surface of said door and between the door and doorframe; wherein the string passes through an eyelet mounted on said doorframe; and wherein said string is accessible from inside of said door.

7. A door holding and releasing device comprising:

a stand placed on a ground adjacent a door;

wherein a doorman rotates atop said stand;

wherein the doorman can hold a door in an open position until rotated via a string thereby releasing said door, and wherein said door rotates to a closed position;

wherein a recoiling means imposes a biasing force upon both the doorman and the stand so as to return the doorman to a return position with respect to the stand;

wherein the doorman has a door catch that is a notch out of the doorman, which is responsible for engaging and holding said door until rotated thereby releasing said door;

wherein the stand is comprised of three posts that form a tri-pod;

wherein a circle bracket having an offset arm are mounted on the stand underneath the doorman; wherein the arm of the circle bracket has a catch; wherein the doorman includes a catch; wherein the recoiling means attaches to catch on the circle bracket and the catch on the doorman;

wherein the doorman has fins that extend vertically and of which engage the arm of the circle bracket so as to return the doorman to the return position.

8. The door holding and releasing device as described in claim 7 wherein feet attach to each post to secure said stand to the ground adjacent the door.

9. The door holding and releasing device as described in claim 8 wherein the feet include attaching means for securing the frame to the ground adjacent the door.

10. The door holding and releasing device as described in claim 7 wherein the string travels across an exterior surface of said door and between the door and doorframe; wherein the string passes through an eyelet mounted on said doorframe; and wherein said string is accessible from inside of said door.

11. A door holding and releasing device comprising:

a stand placed on a ground adjacent a door and wherein the stand is comprised of three posts that form a tri-pod; whereupon feet attach to each post to secure said stand to the ground adjacent the door;

wherein a doorman rotates atop said stand;

wherein the doorman can hold a door in an open position until rotated via a string thereby releasing said door, and wherein said door rotates to a closed position;

wherein a recoiling means imposes a biasing force upon both the doorman and the stand so as to return the doorman to a return position with respect to the stand;

wherein the doorman has a door catch that is a notch out of the doorman, which is responsible for engaging and holding said door until rotated thereby releasing said door;

wherein a circle bracket having an offset arm are mounted on the stand underneath the doorman; wherein the arm of the circle bracket has a catch; wherein the doorman includes a catch; wherein the recoiling means attaches to catch on the circle bracket and the catch on the doorman;

wherein the doorman has fins that extend vertically and of which engage the arm of the circle bracket so as to return the doorman to the return position.

12. The door holding and releasing device as described in claim 11 wherein the feet include attaching means for securing the frame to the ground adjacent the door.

13. The door holding and releasing device as described in claim 11 wherein the string travels across an exterior surface of said door and between the door and doorframe; wherein the string passes through an eyelet mounted on said doorframe; and wherein said string is accessible from inside of said door.

* * * * *